US008459757B2

(12) United States Patent
Gasser

(10) Patent No.: US 8,459,757 B2
(45) Date of Patent: Jun. 11, 2013

(54) FURNITURE DRIVE

(75) Inventor: Ingo Gasser, Höchst (AT)

(73) Assignee: Julius Blum GmbH, Hochst (AT)

( * ) Notice: Subject to any disclaimer, the term of this patent is extended or adjusted under 35 U.S.C. 154(b) by 113 days.

(21) Appl. No.: 12/792,154

(22) Filed: Jun. 2, 2010

(65) Prior Publication Data

US 2010/0237758 A1 Sep. 23, 2010

Related U.S. Application Data

(63) Continuation of application No. PCT/AT2008/000378, filed on Oct. 20, 2008.

(30) Foreign Application Priority Data

Dec. 20, 2007 (AT) ..... A 2077/2007

(51) Int. Cl.
*A47B 95/02* (2006.01)

(52) U.S. Cl.
USPC ..... 312/319.5; 312/334.7

(58) Field of Classification Search
USPC ..... 312/319.1, 319.5–319.8, 330.1, 333, 312/334.6, 334.7
See application file for complete search history.

(56) References Cited

U.S. PATENT DOCUMENTS

| | | | | |
|---|---|---|---|---|
| 6,473,936 | B2 * | 11/2002 | Orita | 16/82 |
| 6,499,818 | B2 * | 12/2002 | Brustle | 312/319.1 |
| 2005/0006998 | A1 | 1/2005 | Kaczmarek | |
| 2006/0061245 | A1 | 3/2006 | Huber et al. | |
| 2006/0261775 | A1 | 11/2006 | Huber et al. | |
| 2007/0046158 | A1 * | 3/2007 | Hoffman | 312/333 |
| 2007/0170828 | A1 * | 7/2007 | Hoshide et al. | 312/319.5 |
| 2008/0191591 | A1 | 8/2008 | Blucher et al. | |

FOREIGN PATENT DOCUMENTS

| | | |
|---|---|---|
| AT | 500 362 | 12/2005 |
| CN | 1914398 | 2/2007 |
| DE | 103 22 682 | 12/2004 |
| EP | 1 455 038 | 9/2004 |
| EP | 1 710 380 | 10/2006 |
| KR | 10-2004-0003554 | 1/2004 |
| WO | 2004/100717 | 11/2004 |
| WO | 2004/100718 | 11/2004 |
| WO | WO2005/073492 | * 8/2005 |
| WO | 2006/029894 | 9/2005 |

(Continued)

OTHER PUBLICATIONS

International Search Report issued Mar. 17, 2009 in International (PCT) Application No. PCT/AT2008/000378.

(Continued)

*Primary Examiner* — James O Hansen
*Assistant Examiner* — Matthew Ing
(74) *Attorney, Agent, or Firm* — Wenderoth, Lind & Ponack, L.L.P.

(57) ABSTRACT

A furniture drive for a pull-out guide system, for driving at least one guide rail of the pull-out guide system, has an electric motor arranged in a housing. The housing has a cup-like portion in which the electric motor is arranged, and has an abutment part for abutment against a wall of a basic furniture structure on which the pull-out guide system is, or can be, fitted. Therefore, in the fitted state of the furniture drive, the electric motor can be arranged in a recess in the wall of the basic furniture structure.

16 Claims, 8 Drawing Sheets

FOREIGN PATENT DOCUMENTS

WO 2005/122832 12/2005

OTHER PUBLICATIONS

Austrian Search Report issued Jul. 25, 2008 in Austrian Patent Application A 2077/2007.

Austrian Patent Office Search Report completed Jul. 25, 2008 in Austrian Patent Application No. A 2077/2007.

Chinese Office Action issued Dec. 13, 2012 in Chinese Patent Application No. 200880120173.X.

* cited by examiner

FURNITURE DRIVE

This application is a continuation application of International application PCT/AT2008/000378, filed Oct. 20, 2008, the entire disclosure of which is incorporated herein by reference.

BACKGROUND OF THE INVENTION

The present invention concerns a furniture drive for an extension guide system comprising an electric motor arranged in a housing. Furniture drives of this kind serve to drive at least one guide rail of the extension guide system. That involves either a drawer rail connected to a drawer or a central rail arranged between the drawer rail and a carcass rail connected to a wall of the body or carcass of the article of furniture.

The invention further concerns an extension guide system for a drawer, comprising at least two guide rails which are displaceable relative to each other and an electric motor for driving at least one guide rail. One of the guide rails is in the form of a drawer rail to be fixed to a drawer and wherein one of the guide rails is in the form of a carcass rail and has a contact portion for bearing against a wall of a furniture carcass. The contact portion has a side that is towards the drawer rail and a side that is remote from the drawer rail.

Furniture drives of the general kind set forth are usually fixed in a position of bearing against a wall of the furniture carcass directly or indirectly by way of carrier elements. AT 500 362 A1 and WO 2005/122832 A1 disclose extension guide systems for drawers, in which an electric motor is connected to a part of the extension guide system.

A problem with those arrangements is the relatively large amount of space required for the electric drive.

Although extension guide systems for the drawer are usually arranged at both walls of the furniture carcass, it is generally sufficient for only one of the extension guide systems to be provided with a furniture drive having an electric motor. In that case, there is the additional problem that the furniture drive provided with the electric drive and thus the corresponding extension guide system requires a larger amount of space than the extension guide system arranged at the other wall.

That, in turn, entails the problem that different amounts of space are required for the respective extension guide system for one and the same drawer in one and the same furniture carcass, at mutually opposite walls.

SUMMARY OF THE INVENTION

The object of the invention is to develop a furniture drive of the general kind set forth, and an extension guide system of the general kind set forth for a drawer in such a way that the furniture drive or the extension guide system requires a smaller amount of space in the furniture carcass.

That object is attained by a furniture drive of the present invention.

The basic idea of the invention is that of designing the furniture drive or arranging the electric motor of the furniture drive on the extension guide system, respectively, in such a way that the electric motor in the mounted condition of the furniture drive or the extension guide system is displaced out of the space between the walls of the furniture carcass into an opening in a wall of the furniture carcass. That means that a furniture drive according to the invention in the mounted condition is almost invisible or an extension guide system according to the invention in the mounted condition takes up only the same amount of space as an extension guide system which is not provided with an electric motor.

It will be appreciated that, instead of being used to drive an extension guide system, a furniture drive according to the invention can also be used for driving a flap drive, a furniture hinge, a portion of an article of furniture directly, or the like.

Further advantageous configurations of the furniture drive according to the invention and the extension guide system according to the will also be described.

The invention also relates to a furniture carcass—preferably with an extension guide system mounted to a wall of the furniture carcass, in particular with an extension guide system according to the invention, and a furniture drive according to the invention, wherein the electric motor is arranged at least partially in an opening in the wall of the furniture carcass.

It is particularly preferable that the electric motor is arranged completely in the opening.

The invention further relates to an article of furniture comprising a furniture carcass of the above-described kind and at least one drawer drivable by the furniture drive.

BRIEF DESCRIPTION OF THE DRAWINGS

Further advantages and details of the invention will be apparent from the Figures and the accompanying specific description. In the Figures.

DETAILED DESCRIPTION OF THE INVENTION

Figure 1:
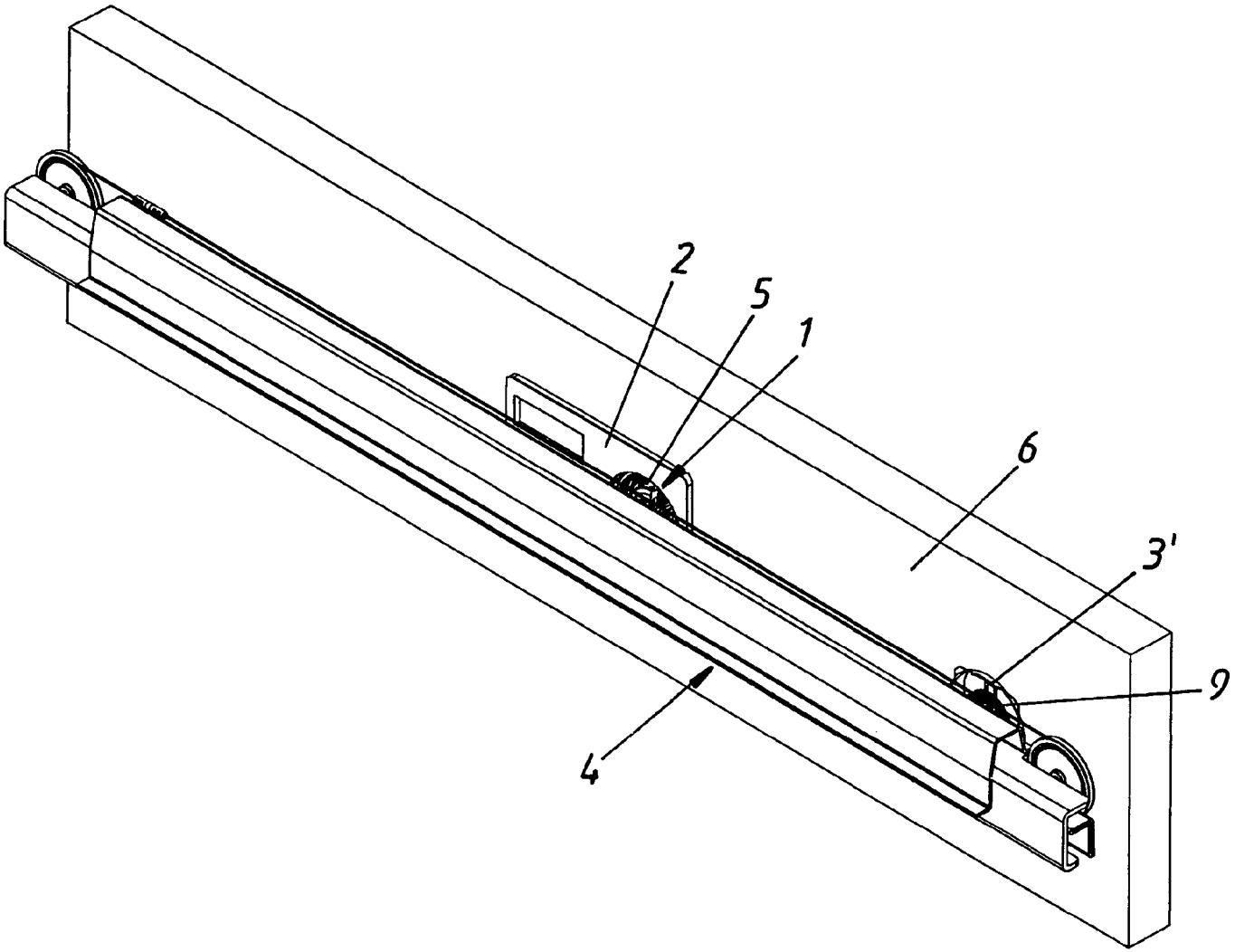
FIG. 1 shows an extension guide system for a drawer comprising a furniture drive according to the invention as a perspective view, mounted to a wall of a furniture carcass.
Figure 2:
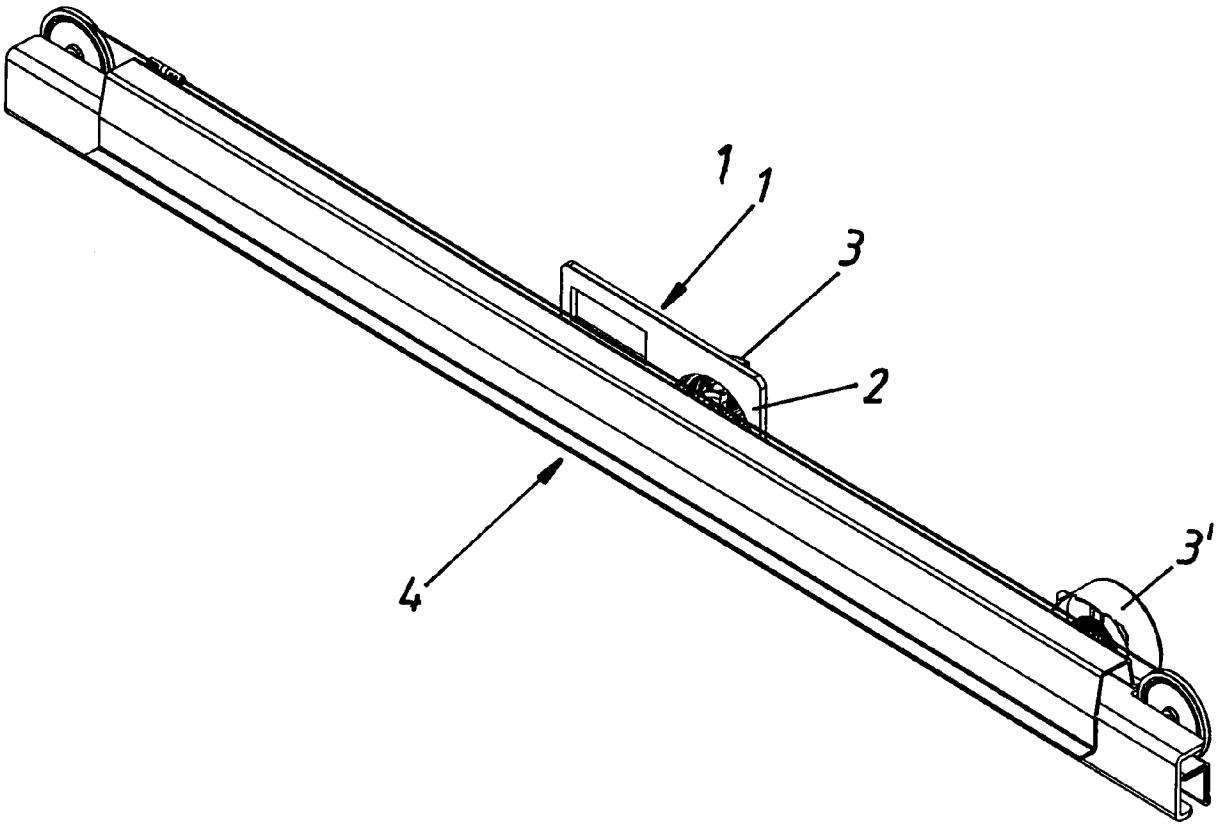
FIG. 2 shows the extension guide system shown in FIG. 1 prior to mounting to a wall.

FIG. 1 shows a portion of a wall 6 of a furniture body or carcass (not shown in greater detail) and an extension guide system 4 mounted to the wall 6 for a drawer (not shown). The extension guide system 4 in a per se known manner comprises a drawer rail which can be connected to the drawer, and a carcass rail for fixing to the wall 6. In this case, the carcass rail comes to bear against the wall 6, with a contact portion 8 (see FIG. 3). As can be seen from FIG. 1, an electric motor 5 is arranged at the side of the contact portion 8, that is remote from the drawer rail (see FIG. 2). In the mounted condition of the extension guide system 4 in the furniture carcass, that affords the situation shown in FIG. 1, in which the electric motor 5 is arranged completely within a first cup-shaped portion 3 to be arranged in an opening 7 in the wall 6 (see also FIG. 4*b*).

Disposed in a second cup-shaped portion 3' is a control or regulating unit (i.e., control unit) 9 for the electric motor 5, to which it is connected by way of lines (not shown).

Figure 3:
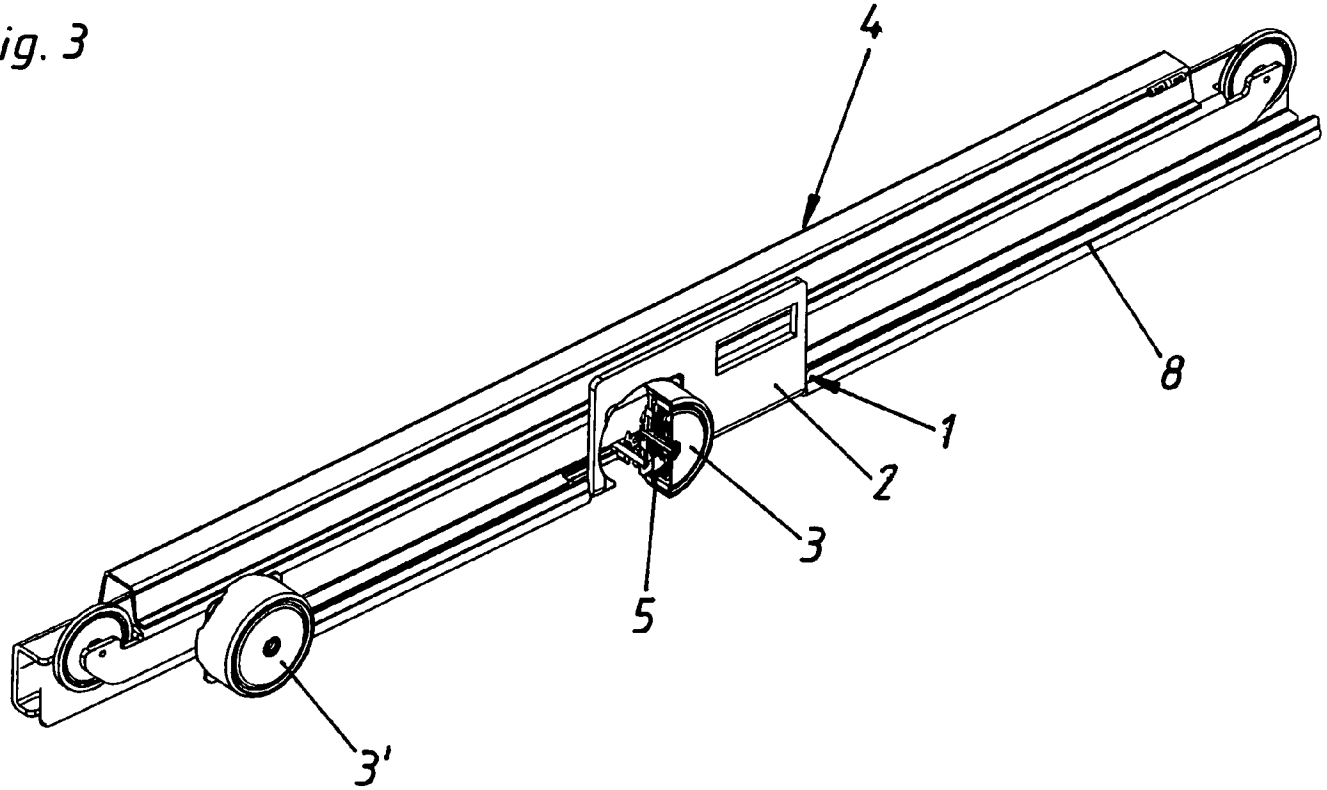
FIG. 3 shows a further view in relation to FIG. 2, FIGS. 4*a* and 4*b* show a plan view and a sectional view relating to the extension guide system of FIGS. 1 through 3, FIGS. 5*a* and 5*b* show a perspective view and a sectional view of a furniture drive according to the invention.

In the illustrated embodiment, the electric motor 5 is part of a furniture drive 1 having a housing, the housing comprising the first cup-shaped portion 3 and a plate-shaped contact portion (abutment part) 2. The first cup-shaped portion 3 receives the electric motor 5. The contact portion 2 allows the furniture drive 1 to bear against the wall 6. As illustrated in FIG. 3, the second cup-shaped portion 3' and the first cup-shaped portion 3 are independent and spaced apart from each other along the rails of extension guide system 4.

In the illustrated embodiment, the furniture drive 1 is connected to the extension guide system 4 by a fixing member.

In principle, it would also be conceivable for the furniture drive 1 to be fixed separately from the extension guide system 4 to the wall 6 of the furniture carcass.

In this embodiment, the housing of the furniture drive 1 has an integral configuration. That, however, is not absolutely necessary.

FIG. 3 shows a rear view of the extension guide system 4 together with the furniture drive 1 mounted thereto.

Figure 4B:
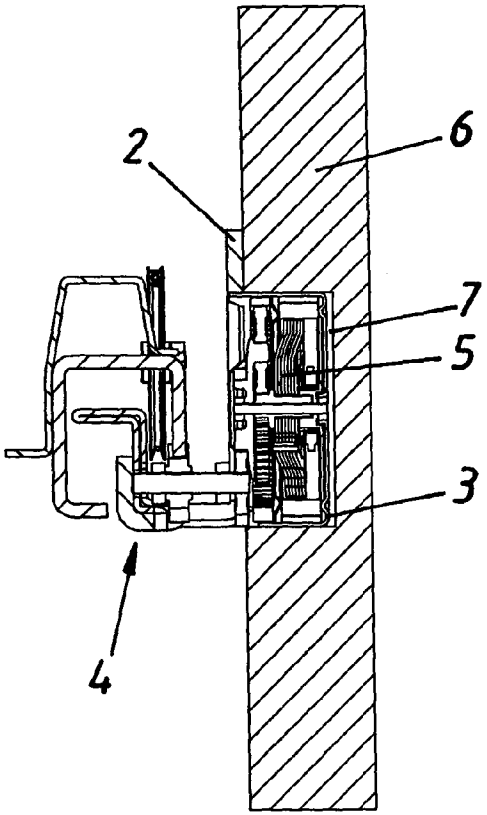
Figure 4A:
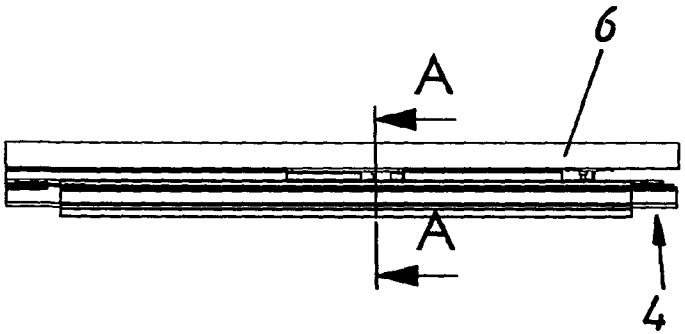

FIGS. 4*a* and 4*b* show once again the arrangement of the first cup-shaped portion 3 with the electric motor 5 arranged in the first cup-shaped portion 3, in an opening 7 in the wall 6. It will be seen that, by virtue of that feature, the furniture drive 1 itself does not take up any space in the interior of the furniture carcass, that is to say between the walls 6 of the furniture carcass. The extension guide system 4 is admittedly drivable by the furniture drive 1 but it does not take up a larger amount of space than an extension guide system which has no furniture drive.

Figure 5B:
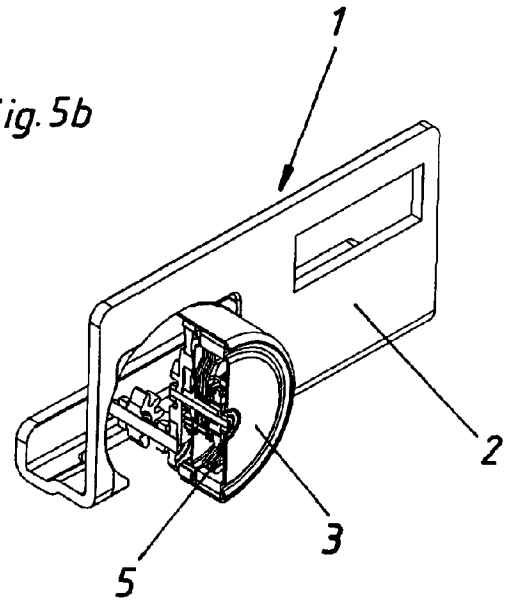
Figure 5A:
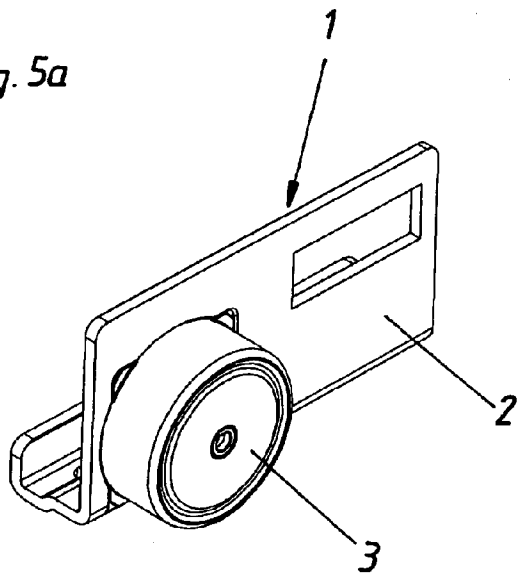

FIGS. 5*a* and 5*b* show the furniture drive 1 according to the invention as a perspective view and partially in section. As shown in these figures, the first cup-shaped portion 3 projects from a furniture-facing side of the contact portion 2.

Figure 6A:
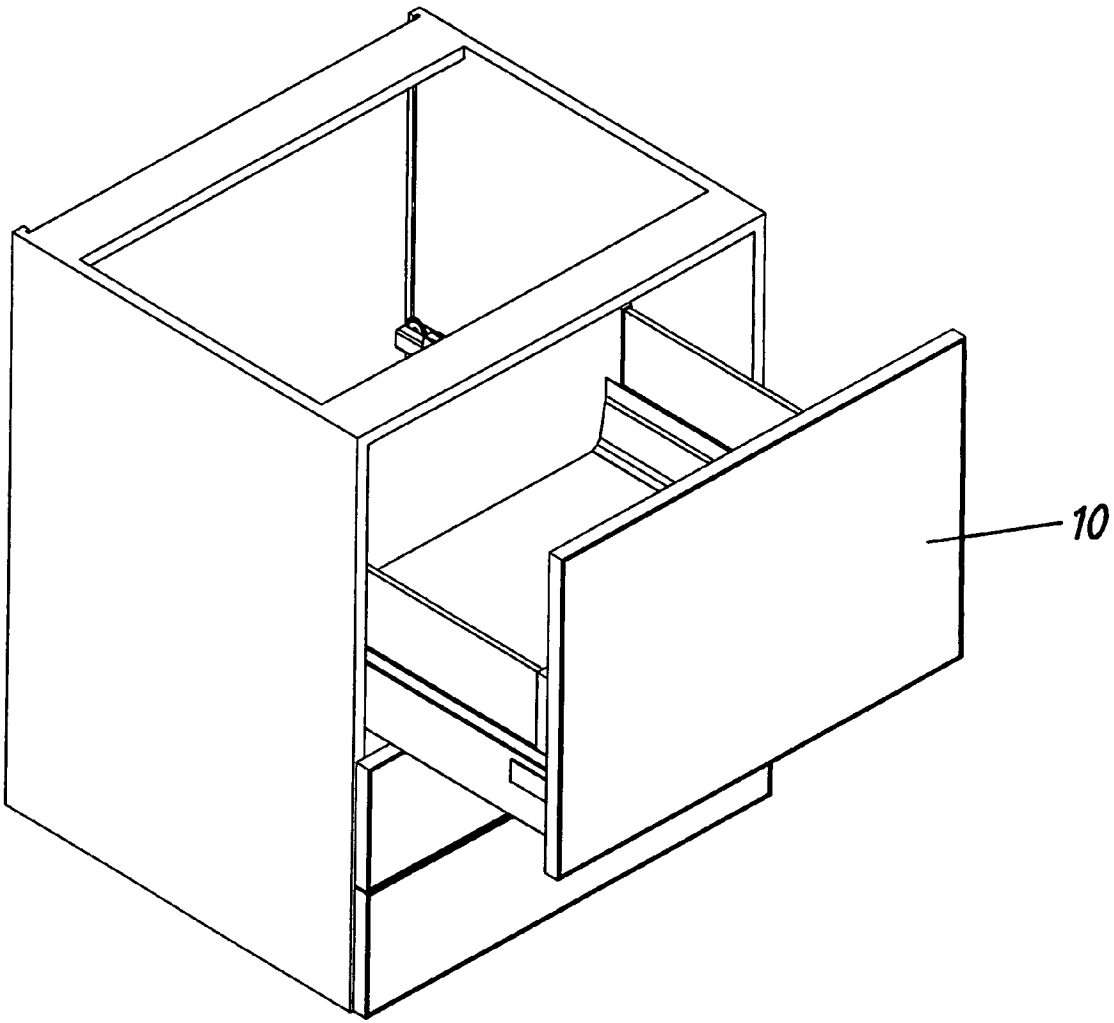
FIGS. 6*a* and 6*b* show two views of a furniture carcass with an extension guide system according to the invention.
Figure 6B:
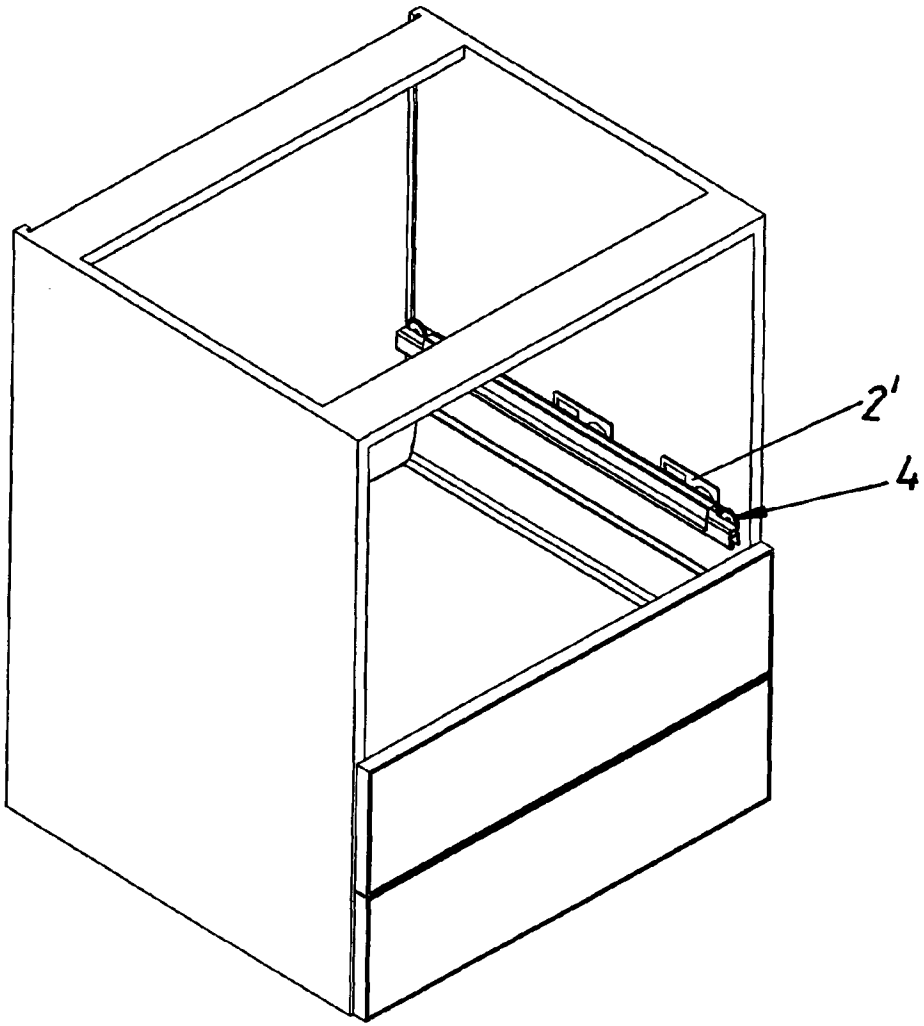
Figure 7:
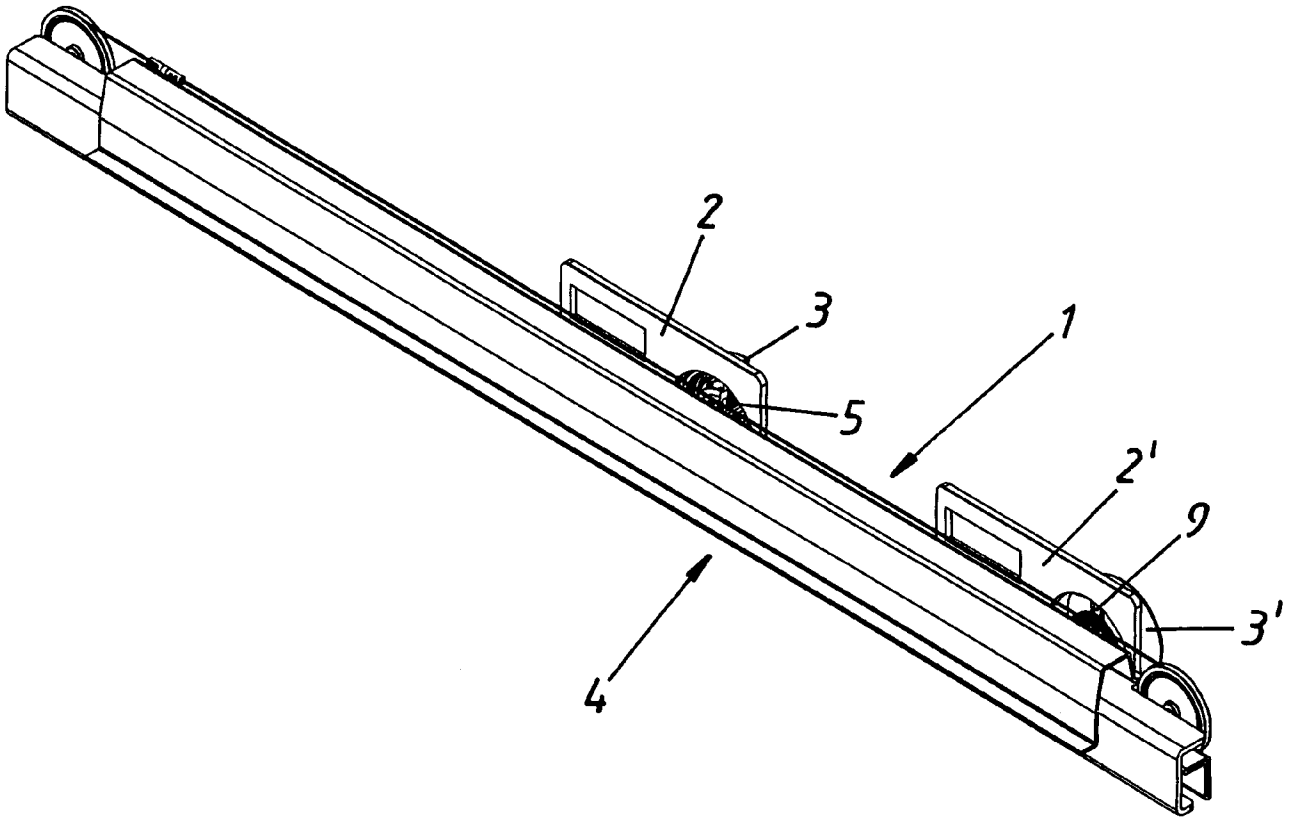
FIG. 7 shows an embodiment of an extension guide system according to the invention, shown in the mounted condition in FIGS. 6*a* and 6*b*.

FIGS. 6*a* and 6*b* show a furniture carcass having a drawer 10 (this can be seen only in FIG. 6*a*) and an extension guide system 4 according to the invention. In this embodiment, the housing portion with the second cup-shaped portion 3' in which the control or regulating unit is disposed also has a contact portion 2' (see FIG. 6*b*) (see FIG. 7).

The invention claimed is:

1. A furniture drive for driving at least one guide rail of an extension guide system, said furniture drive comprising:

a housing having a first cup-shaped portion and a first contact portion for bearing against a wall of a furniture carcass to which said furniture drive is to be mounted;

an electric motor arranged in said first cup-shaped portion of said housing, said first cup-shaped portion being configured such that, in a mounted condition of said furniture drive, said first cup-shaped portion is located within an opening of the wall of the furniture carcass so that said electric motor is at least partially located in the opening of the wall;

a control unit for controlling said electric motor; and a second cup-shaped portion and a second contact portion for bearing against the wall of the furniture carcass, said control unit being arranged in said second cup-shaped portion, said second cup-shaped portion being arranged independently of said first cup-shaped portion; said first cup-shaped portion and said second cup-shaped portion being separate components to be spaced apart from each other along a rail of the extension guide system.

2. The furniture drive as set forth in claim 1, wherein each of said first contact portion and said second contact portion has a plate-shaped configuration.

3. The furniture drive as set forth in claim 2, wherein said first cup-shaped portion projects from a furniture-facing side of said first contact portion.

4. The furniture drive as set forth in claim 1, wherein said first contact portion has a fixing member for fixing said furniture drive to the extension guide system.

5. The furniture drive as set forth in claim 1, wherein said electric motor is completely arranged in the opening in the wall of the furniture carcass in the mounted condition of said furniture drive.

6. An extension guide system for moving a drawer, comprising:

at least two guide rails displaceable relative to each other, said at least two guide rails including a drawer rail to be fixed to the drawer and a carcass rail having:

a first cup-shaped portion;

a contact portion for bearing against a wall of a furniture carcass to which said extension guide system is to be mounted; and a second cup-shaped portion, said second cup-shaped portion being arranged independently of said first cup-shaped portion;

an electric motor arranged in said first cup-shaped portion for driving said drawer rail, said first cup-shaped portion being configured such that, in a mounted condition of said extension guide system, said first cup-shaped portion is located within an opening of the wall of the furniture carcass so that said electric motor is at least partially located in the opening of the wall; and a control unit for controlling said electric motor, said control unit being arranged in said second cup-shaped portion;

wherein said contact portion of said extension guide system is at least partly formed of a housing contact portion of a furniture drive, said furniture drive including said electric motor arranged in said first cup-shaped portion.

7. The extension guide system as set forth in claim 6, wherein said contact portion has a plate-shaped configuration.

8. The extension guide system as set forth in claim 7, wherein said first cup-shaped portion projects from a furniture-facing side of said contact portion.

9. The extension guide system as set forth in claim 6, wherein said electric motor is completely arranged in the opening in the wall of the furniture carcass in the mounted condition of said extension guide system.

10. An extension guide system for moving a drawer, comprising:

at least two guide rails displaceable relative to each other, said at least two guide rails including a drawer rail to be fixed to the drawer and a carcass rail having:

a first cup-shaped portion;

a contact portion for bearing against a wall of a furniture carcass to which said extension guide system is to be mounted; and a second cup-shaped portion, said second cup-shaped portion being arranged independently of said first cup-shaped portion;

an electric motor arranged in said first cup-shaped portion for driving said drawer rail, said first cup-shaped portion being configured such that, in a mounted condition of said extension guide system, said first cup-shaped portion is located within an opening of the wall of the furniture carcass so that said electric motor is at least partially located in the opening of the wall; and a control unit for controlling said electric motor, said control unit being arranged in said second cup-shaped portion;

wherein said first cup-shaped portion and said second cup-shaped portion are separate components to be spaced apart from each other along said carcass rail of said at least two guide rails.

11. An article of furniture comprising:

a furniture carcass;

a drawer movable with respect to said furniture carcass; and a furniture drive for driving a drawer rail of an extension guide system, said furniture drive including:

a housing having a first cup-shaped portion and a first contact portion for bearing against a wall of said furniture carcass;

an electric motor arranged in said first cup-shaped portion of said housing, said first cup-shaped portion being configured such that, in a mounted condition of said furniture drive, said first cup-shaped portion is located within an opening of said wall of said furniture carcass so that said electric motor is at least partially located in said opening of said wall;

a control unit for controlling said electric motor; and a second cup-shaped portion and a second contact portion for bearing against said wall of said furniture carcass, said control unit being arranged in said second cup-shaped portion, said second cup-shaped portion being arranged independently of said first cup-shaped portion;

wherein said first cup-shaped portion and said second cup-shaped portion are separate components to be spaced apart from each other along a rail of an extension guide system mounted to said furniture carcass and said drawer.

12. The article of furniture of claim 11, wherein said electric motor is arranged completely in said opening of said wall of said furniture carcass.

13. The article of furniture of claim 11, further comprising an extension guide system mounted to said wall of said furniture carcass, said extension guide system including:

a drawer rail fixed to said drawer; and a carcass rail fixed to said furniture carcass, said carcass rail having a carcass contact portion for bearing against said wall of said furniture carcass.

14. The article of furniture of claim 11, wherein each of said first contact portion and said second contact portion has a plate-shaped configuration.

15. The article of furniture of claim 14, wherein said first cup-shaped portion projects from a furniture-facing side of said first contact portion.

16. The article of furniture of claim 11, wherein said first contact portion has a fixing member for fixing said furniture drive to an extension guide system.

* * * * *